United States Patent [19]

Folsberg

[11] Patent Number: 4,582,260

[45] Date of Patent: Apr. 15, 1986

[54] METHOD OF AND PLANT FOR GRINDING PULVERULENT OR GRANULAR MATERIALS

[75] Inventor: Jan Folsberg, Copenhagen, Denmark

[73] Assignee: F. L. Smidth Co. A/S, Denmark

[21] Appl. No.: 551,947

[22] Filed: Nov. 15, 1983

[30] Foreign Application Priority Data

Dec. 16, 1982 [GB] United Kingdom ..... 8235900

[51] Int. Cl.[4] ..... B02C 15/00

[52] U.S. Cl. ..... 241/19; 241/24; 241/80; 241/97; 241/119

[58] Field of Search ..... 241/79.1, 48, 52, 117, 241/118, 119, 120, 121, 19, 24, 80, 97

[56] References Cited

U.S. PATENT DOCUMENTS 2,480,998 9/1949 Brackett ..... 241/97 X
3,002,701 10/1961 Kayatz ..... 241/52
3,375,982 4/1968 Lease ..... 241/52 X
3,951,347 4/1976 Tiggesbaumker et al. ..... 241/52

*Primary Examiner*—Mark Rosenbaum
*Attorney, Agent, or Firm*—Brumbaugh, Graves, Donohue & Raymond

[57] ABSTRACT

A vertical roller mill has a grinding table (1), rollers (3) and a separator (6) for separating ground material, which is conveyed to the separator in an air stream supplied through an inlet (7), into a fine fraction, which passes out through an outlet (8), and a coarse fraction which is returned for further grinding through an outlet (10). A part of the ground material is conveyed through an outlet (11) to a second separator (13), where it is separated from the air and returned for further grinding via an outlet (14) and an inlet (9) for fresh material to the mill. This provides a flatter grain size distribution curve in the finish ground material.

2 Claims, 1 Drawing Figure

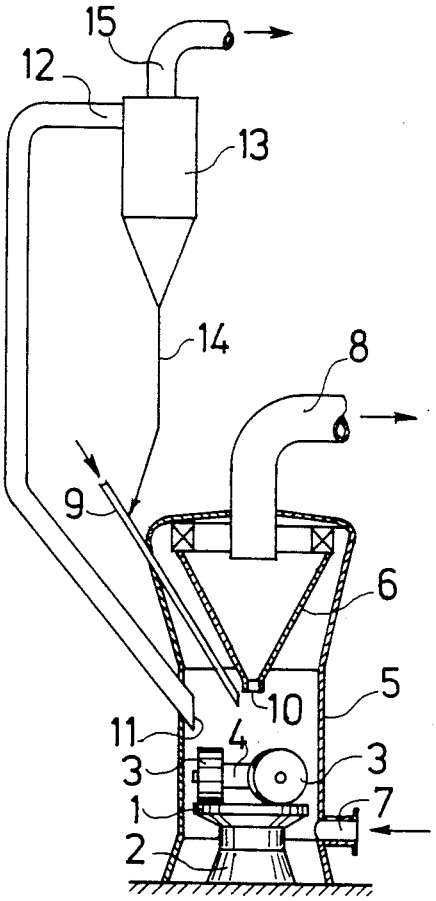
15
12
13
14
8
9
6
5
10
11
4
3
3
1
7
2

METHOD OF AND PLANT FOR GRINDING PULVERULENT OR GRANULAR MATERIALS

The invention relates to a method of grinding pulverulent or granular materials, such as cement clinker, by means of a plant comprising a gas-swept vertical roller mill having a rotating grinding table and grinding rollers, and a first separator for separating finish ground material from insufficiently ground material, the finish ground material being discharged from the separator and the insufficiently ground material being returned to the grinding table for further grinding. Such a method and plant are hereinafter referred to as of the kind described.

Mills of the above kind are widely used for grinding lump raw materials, such as coal and cement raw materials, but have, up to now, achieved no extensive use as cement mills for the finish grinding of cement, although the specific energy consumption of roller mills is considerably lower than that of the hitherto commonly used tube mills.

The limited use of vertical roller mills for finish grinding of cement is due to the fact that the finish ground material from a roller mill has a steeper grain size distribution curve than that of the product from a tube mill. It is common knowledge that cement having a steep grain size distribution curve possesses certain technical disadvantages i.e. with regard to the desired strength development in concrete manufactured from such a cement.

The grain size distribution curve of the finish ground material is determined by the separation process used, i.e. by the separator and its separating ability or separation curve. The curve is S-shaped in a graph, the ordinate of which indicates the percentage of that grain size fraction of the material feed to the separator, which is separated as a coarse fraction to be returned to the mill for further grinding; and the abscissa of which indicates the actual grain size. A steep curve indicates that the separation process has a high sorting capacity or a high separation sharpness, and a flat curve that the separation sharpness is lower.

Thus it is advantageous that cement has a relatively flat grain size distribution curve, and in order to counteract a steep grain size distribution curve when grinding cement in a vertical roller mill, it has therefore been suggested to let a part of the partly ground material by-pass by mill separator. However, this results in the finished product comprising an undesired content of very coarse particles.

It is therefore the object of the invention to provide a method for finish grinding of e.g. cement by means of a vertical roller mill without the above-mentioned disadvantage.

According to the invention this is achieved by a method of the kind described characterized in that a part of the ground material is removed from a mill grinding chamber before being fed to the first separator, and in that the removed part of the material is separated in a second separator from the conveying gas and returned to the grinding table for further grinding.

By such a method the removed material, containing both a coarse and fine fraction, is returned e.g. together with the fresh feed of material back onto the grinding table whereby an additional grinding of part of the fine fraction of already ground material is obtained. This creates a less steep grain size distribution curve of the finished product of the plant.

By a suitable adjustment of the capacity of the first separator and a suitable choice of the percentage of material, which is removed from the grinding chamber and passed to the second separator and subsequently back to the mill, it is possible to achieve a grain size distribution curve acceptable for the finish grinding of cement.

The invention also includes a plant of the kind described for carrying out the above method, the plant being characterized by a second separator having an inlet for ground material suspended in gas, the second separator inlet being connected by a pipe to an outlet located in a housing of the mill between the grinding table and an inlet of the first separator; the second separator also having an outlet for material separated in the second separator, and the second separator outlet being connected to an inlet to the mill.

A plant of this kind further achieves a reduction of the total fan power requirement of the plant, as the part of the conveying gas for the removed part of the ground material passed through the second separator can be passed directly therefrom to a dust precipitator of the plant, and only the remaining part of the conveying gas is passed through the first separator and further in a known manner through a third separator for separating the finish ground material from the conveying gas before passing the latter to the precipitator.

The invention is explained in more detail below by reference to the accompanying FIGURE of the drawing which diagrammatically shows an example of a plant according to the invention in side elevation.

The plant comprises a vertical roller mill with a grinding table 1 rotating about its vertical axis and driven via a gear 2.

Rolling on the grinding table 1 are grinding rollers 3. In the example shown these are mounted on a common carrying frame 4 and are urged against the grinding table 1 by means of known, but not shown, pull and pressure means.

The mill is encased by a housing 5 which has at its top a built-in separator 6 and at its bottom an inlet 7 for the supply of conveying gas up around the grinding table and further up through the mill into the separator 6 and out through a top outlet 8.

Further, the mill has a supply duct 9 for fresh unground material.

During mill operation unground material is supplied through the duct 9 down onto the rotating grinding table 1 where it is ground by means of the rollers 3.

Material ground on the table 1 passes radially outwardly from the table by its rotation and is suspended in the conveying gas which passes up around the grinding table 1.

The gas carries the partly ground material in suspension up through the housing 5 into the built-in separator 6 where the suspended material is divided into a coarse fraction which is returned to the grinding table 1 via a separator bottom outlet 10, and a fine fraction which passes entrained in the conveying gas out of the mill via the top outlet 8 as finish ground material. This finished material, e.g. cement, may have too steep a grain size distribution curve for manufacturing concrete.

Accordingly, the mill housing is further provided with an outlet 11 in the wall between the grinding table 1 and the separator 6, and this outlet is, through a pipe, connected with an inlet 12 of another separator 13 having a bottom outlet 14 connected with the inlet duct 9 for fresh unground material. The separator 13 furthermore has a gas outlet 15.

Through the outlet 11 a percentage of conveying gas and the ground material from the grinding table 1 is taken out and led to the other separator 13. This part of the ground material contains both coarser and finer grains which are separated in the separator 13 and subsequently conveyed through the outlet 14 down into the inlet duct 9 to be mixed with fresh, unground material and hence passed to the grinding table 1. In this way, a part of the fine material fraction is subjected to a second grinding process before being finally passed together with the remaining gas and ground material to the separator 6 and separated therein before discharge as finished material. By this additional grinding of a part of the fine fraction a flatter grain size distribution curve of the end product from the plant is obtained.

Thus it is possible without adjusting the grinding pressure, the amount of gas through the mill or the separator setting, to alter the power consumption of the mill, as the grinding cushion thickness of the material on the grinding table is increased as a result of the second grinding process of the material passing via the second separator. This increases the grinding efficiency of the plant, which again provides the above possibility of changing the grain size distribution curve of the finished material advantageously.

I claim:

1. In a method of grinding pulverulent or granular material by means of a gas-swept vertical roller mill using a rotating grinding table and grinding rollers in a grinding chamber, and a first separator for separating finish ground material from insufficiently ground material, said finish ground material being discharged from said separator and said insufficiently ground material being returned to said grinding table for further grinding, the improvement comprising sweeping the grinding table with a gas such that ground material containing both coarse and fine particles is entrained therein for conveyance to said first separator, removing a portion of said material containing both coarse and fine particles entrained in said gas before it is conveyed to said first separator and conveying said portion of said material instead to a second separator, and in said second separator separating said portion of said material from the gas and returning substantially to said grinding table for further grinding said portion of said material such that said portion so returned has substantially the same particle size distribution as said portion removed from said entrained material.

2. A method according to claim 1, wherein said portion so returned is returned to said grinding table by being introduced into a feed of fresh unground material to said mill.

* * * * *

UNITED STATES PATENT AND TRADEMARK OFFICE

CERTIFICATE OF CORRECTION

PATENT NO. : 4,582,260

DATED : April 15, 1986

INVENTOR(S) : Jan Folsberg

It is certified that error appears in the above-identified patent and that said Letters Patent is hereby corrected as shown below:

Column 1, line 50, "by mill" should read --the mill-- per application, page 2, line 20. Column 4, line 19, delete "substantially".

Signed and Sealed this

*Nineteenth* Day of *August 1986*

[SEAL]

*Attest:*

DONALD J. QUIGG

*Attesting Officer*

*Commissioner of Patents and Trademarks*